United States Patent [19]

Rowe

[11] 4,167,486

[45] Sep. 11, 1979

[54] LUBRICANT COMPOSITION CONTAINING A LUBRICITY AGENT

[75] Inventor: Carleton N. Rowe, Yardley, Pa.

[73] Assignee: Mobil Oil Corporation, New York, N.Y.

[21] Appl. No.: 926,463

[22] Filed: Jul. 20, 1978

Related U.S. Application Data

[63] Continuation-in-part of Ser. No. 827,507, Aug. 25, 1977, abandoned.

[51] Int. Cl.[2] ..... C10M 1/24; C10M 3/18; C10M 5/12; C10M 7/20

[52] U.S. Cl. ..... 252/56 R

[58] Field of Search ..... 252/56 R

[56] References Cited

U.S. PATENT DOCUMENTS

| | | | |
|---|---|---|---|
| 3,062,745 | 11/1962 | Gaynor et al. | 252/56 R |
| 3,223,635 | 12/1965 | Dwyer et al. | 252/56 R |
| 3,329,611 | 7/1967 | Chao | 252/56 R |
| 3,574,574 | 4/1971 | Moore et al. | 44/66 |
| 3,629,114 | 12/1971 | Fairing | 252/56 R |

*Primary Examiner*—Delbert E. Gantz
*Assistant Examiner*—Irving Vaughn
*Attorney, Agent, or Firm*—Charles A. Huggett; Raymond W. Barclay; Claude E. Setliff

[57] ABSTRACT

Lubricating oils containing olefin polymerizable acid esters and dimers and/or trimers thereof have been found to increase fuel economy in internal combustion engines. This is done by deposition of the additive on the lubricated surface.

15 Claims, No Drawings

LUBRICANT COMPOSITION CONTAINING A LUBRICITY AGENT

CROSS REFERENCE TO RELATED APPLICATIONS

This is a continuation-in-part of U.S. Application Ser. No. 827,507, filed Aug. 25, 1977, now abandoned.

BACKGROUND OF THE INVENTION

1. Field of the Invention

The invention relates to a method for reducing fuel consumption in internal combustion engines. It more particularly relates to reducing fuel consumption by adding a dimer or trimer of a polymerizable acid.

2. Discussion of the Prior Art

For several years there have been numerous efforts to reduce the amount of fuel consumed by automobile engines and the like. The search for ways to do this was given added impetus by the oil embargo. Many of the solutions have been strictly mechanical, as for example, setting the engine for a leaner burn or simply building smaller cars and smaller engines.

Other efforts have revolved around finding lubricants that reduce the overall friction in the engine, thus allowing a reduction in energy requirements thereto. A considerable amount of work has been done with mineral lubricating oils and greases, modifying them with additives to enhance their friction properties. On the other hand, new lubricants have been synthesized and compounded for use in modern engines. Among these is Mobil 1, a synthetic hydrocarbon fluid and synthetic ester blend, which is known to reduce fuel consumption by a significant amount. It is, however, the physical properties of the oil itself that provide improved lubricating (and thus improved fuel consumption) and not the additives present.

So far as is known, no effort has been made to place the acid esters of this invention in a lubricating oil. U.S. Pat. No. 3,429,817 discloses the addition to a lubricating oil of an ester made by reacting a $C_2$–$C_5$ glycol with a $C_{36}$ dicarboxylic acid dimer, such as the dimer of linoleic acid. It is stated to be a lubricity agent. Similarly, U.S. Pat. No. 3,390,083 discloses a mineral lubricating oil containing an antiwear agent made by reacting a $C_1$–$C_{20}$ glycol and alcohol with a $C_{36}$ dicarboxylic acid, such as the linoleic acid dimer.

Several patents disclose the use of dimer and trimer acid as an ingredient in motor fuels. U.S. Pat. No. 3,574,574 for example, teaches that by adding esters of dimer and trimers of linoleic acid (as for example the triisodecyl ester of the trimeric linoleic acid) one gets a fuel that promotes reduced intake valve and port deposits. Others that teach the presence of linoleic acid derivatives in motor fuels are U.S. Pat. Nos. 3,846,098, 2,767,144, 3,782,912, 3,844,731 and 3,925,030.

SUMMARY OF THE INVENTION

In accordance with the invention, there is provided a method for reducing fuel consumption in an internal combustion engine by treating the moving surfaces thereof with a composition comprising a major amount of a lubricant containing a fuel reducing amount of an acid ester that is soluble in a predominant amount of a hydrocarbon oil, either mineral or synthetic, and that has at least two olefinic double bonds, at least one pair of which has one of the following configurations:

$$-C{=}C-C-C{=}C-$$

and $$-C{=}C-C{=}C-$$

or (2) the dimer or trimer of such acid ester whereby said acid ester, trimer or dimer is deposited on the said moving surfaces.

DESCRIPTION OF SPECIFIC EMBODIMENTS

It has been estimated that a modern car weighing about 4300 pounds with a 10:1 compression ratio and travelling at 40 mph on a level roadway has available for propelling it only 13.1% of the energy available in the gasoline burned. The losses are due primarily to fuel pumping, tare, friction, transmission, rear axle, tires, and wind resistance. The actual fuel used in propelling the vehicle amounted to 16.7 mpg. If all fuel were used in propelling the vehicle, it could travel 128 miles on a gallon of gasoline.

Of the energy loss, approximately 5%, or 6.4 mpg, can be accounted for in loss due to lubricated engine components. Consequently, a mere 10% decrease in boundary and viscous friction would lead to a 3.8% increase in fuel economy (from 16.7 mpg to 17.3 mpg). It is little wonder, then, that energy companies are concerned with finding new lubricants or new additives that have superior lubricity properties.

As was mentioned hereinabove, one method of boosting fuel economy is to optimize the lubrication of the engine and drive train; that is, minimize friction losses between lubricated moving parts. The benefit of Mobil 1 over, for example, Mobil Super is better than 4%, attained solely by lowering of the viscous friction of the engine lubricant. Additional improvements may be realized by modification of the boundary friction of the lubricant.

In accordance with this invention, it has been found that acid esters having multiple olefinic polymerizable double bonds, i.e., at least two such olefinic double bonds and are soluble in a lubricating oil containing a predominant amount of a hydrocarbon oil, either mineral or synthetic, are effective to increase fuel economy in internal combustion engines. Those acid esters which are effective are those having at least two of the double bonds paired in one of the following configurations:

$$-C{=}C-C-C{=}C-$$

and $$-C{=}C-C{=}C-$$

One embodiment of the invention consists of employing a lubricating oil containing an ester of the formula $$R-CH{=}CHCH_2CH{=}CH(CH_2)_nC(=O)-OR'$$

wherein R is a $C_1$–$C_{12}$ hydrocarbyl group, R′ is a $C_1$–$C_{20}$ hydrocarbyl group and n is 0 to 11. The hydrocarbyl group may be aryl, such as phenyl, and the alkyl substituted members thereof, and aralkyl, such as phenylethyl and the like. Both R and R′ are preferably alkyl groups, both straight- and branched-chains. The alkyl may be, for example, methyl, ethyl, propyl, butyl, octyl, tetradecyl, octadecyl and eicosyl. Both are straight- and branched-chain, and it is intended that all combinations of R and R′ with such groups, as well as with each hydrocarbyl named hereinabove, are included within this disclosure.

In another embodiment of the invention, the dimers and/or trimers of the above ester are employed in the lubricating oil. Where mixtures of the dimer and trimer are used, it will be composed of from about 10% to about 90% by weight of the dimer to from about 90% to about 10% by weight of the trimer.

I prefer to use the dimers or trimers (or mixtures thereof) of linoleic acid esters of the formula $$CH_3(CH_2)_4CH{=}CHCH_2CH{=}CH(CH_2)_7COOR'$$

wherein R′ is an alkyl group having from 1 to 20 carbon atoms. These include, as has already been mentioned, methyl, ethyl, propyl, butyl, octyl, tetradecyl, octadecyl and eicosyl.

It will be noted that the above disclosure refers to dimers and trimers of the ester monomer. It is contemplated that the ester monomer can be polymerized to form such dimers and trimers. For example, the dimer ester may be formed as follows, using linoleic acid ester as an example:

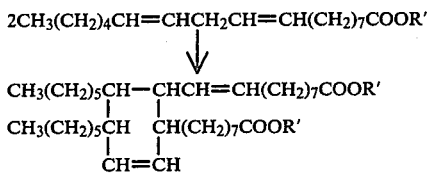

However, when the dimer or trimer ester is used as the additive, I prefer to make or otherwise obtain the dimer or trimer of the acid per se and to react this with the appropriate alcohol in accordance with the following illustration.

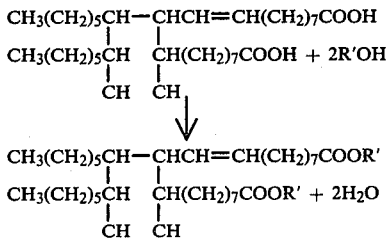

The trimer is made similarly, using 1 mole of the acid trimer and 3 moles of alcohol.

In general, the acids and the dimers and trimers thereof may be reacted with a hydrocarbyl monohydric alcohol, the hydrocarbyl containing from 1 to 20 carbon atoms to yield the ester. The reaction is carried out at from about 50° C. to about 300° C., preferably at from about 100° C. to about 250° C. The alcohol is used in an amount equivalent to the carboxyl present, plus up to about 10% excess if desired. The time of reaction will vary, depending upon the alcohol used, but will generally range from about 2 hours to about 20 hours.

For example, a linoleic acid polymer mixture containing about 75% by weight of dimer and 25% by weight of trimer can be made by heating the linoleic acid in the presence of water at temperatures of from about 300° C. to about 400° C. and at superatmospheric pressure. While the dimer and trimer acids, as well as the trimer, can be made in the laboratory, they are readily available from commercial sources.

The amount of ester in the lubricant will usefully range from about 0.5% to about 10%, preferably from about 0.5% to about 2% by weight.

The lubricating oils contemplated for use with the esters herein disclosed include both mineral and synthetic hydrocarbon oils of lubricating viscosity and mixtures thereof with other synthetic oils. The synthetic hydrocarbon oils include long chain alkanes such as cetanes and olefin polymers such as trimers and tetramers of octene and decene. The synthetic oils with which these can be mixed include (1) ester oils such as pentaerythritol esters of monocarboxylic acids having 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, or mixtures thereof with di- and tripentaerythritol, and an aliphatic monocarboxylic acid containing from 1 to 20 carbon atoms, or mixtures of such acids.

As has been stated, the unexpected function of the composition is a reduction in the amount of gasoline consumed. It is believed that the lubricant composition accomplishes this by polymerization of the acid ester, or the dimer or trimer thereof, on the sliding surfaces of the lubricated internal components of the engine to form a polymeric film having a low coefficient of friction.

Having described the invention in general terms, the following are offered to specifically illustrate the development. It is to be understood they are illustrations only and that the invention shall not be limited except as limited by the appended claims.

EXAMPLE 1

This Example shows the preparation of the triisodecyl ester of the trimer of linoleic acid. The trimer acid (sold by Emery Industries) was designated Empol 1041 and contained 90% of the trimer acid and 10% of the dimer acid.

A mixture of 309 g. (0.33 mole) of the trimer acid and 158 g. (1.0 mole) of isodecanol was stirred to about 235° C. in the presence of 1 g. of para-toluene sulfonic acid over a period of about 8 hours. 18 g. (1.0 mole) of water was collected. The product was the trimerate ester.

Evaluation of the Product

Fuel meters were installed in two cars. Records were kept of the quantity of fuel consumed on short trips. New oil and new filters were installed at the beginning of the test. New spark plugs and new points were installed and the car timed if necessary. The table below is a summary of the results using 1% triisodecyl ester of the trimer of linoleic acid (trimerate ester) added to Mobil Super in the two cars. A 1974 Pinto station wagon was equipped with a Spacekom fuel meter which reads to the nearest 0.01 gallon. A 1961 Plymouth was equipped with a Conaflow fuel meter which reads to the nearest 0.0001 gallon, but is read under the hood and the engine had to be stopped to obtain an accurate reading.

TABLE 1

| Fuel Economy Results for Trimerate Ester in Two Vehicles | 1974 Pinto (22,000 miles) | | 1961 Plymouth (68,000 miles) | |
|---|---|---|---|---|
| | Mobil Super | 1% Trimerate Ester in Mobil Super | Mobil Super | 1% Trimerate Ester in Mobil Super |
| Trip length, miles | 8.75 | 8.75 | 13.83 | 13.83 |
| Number of trips | 11 | 13 | 16 | 13 |
| Average car temp., °F. (start of trip) | 24 | 30 | 25 | 38 |
| Temperature spread, °F. | 10–40 | 18–44 | 20–35 | 22–53 |
| Average fuel consumption in gallons | 0.489 | 0.466 | 0.9083 | 0.8677 |
| Least Square Analysis* | | | | |
| B | 0.558 | 0.528 | 0.9790 | 0.9430 |
| M | −0.00287 | −0.00205 | −0.00230 | −0.00200 |
| Average fuel consumption corrected to average test temperature (°F.) | 0.481 (27° F.) | 0.472 (27° F.) | 0.8922 (31° F.) | 0.8809 (31° F.) |
| 80% Confidence Limits | ±0.0048 (±1.0%) | ±0.0055 (±1.2%) | ±0.0078 (±0.9%) | ±0.0068 (±0.8%) |
| Miles per gallon | 18.19 | 18.54 | 15.50 | 15.70 |
| % benefit for additive | — | 1.9% | — | 1.3% |

*gallons = M(T°F.) + B

The results summarized in Table 1 show a 1.9% advantage for the additive in the Pinto and a 1.3% advantage for the additive in the Plymouth and are calculated by correcting the individual results for temperature. With both cars, the data for Mobil Super without trimerate ester were obtained during January when it was extremely cold, while the data for the additive was obtained mostly after the extreme cold temperatures. This was especially the case for the Plymouth data. A least square analysis of the fuel consumption as a function of temperature was made for each set of data and the fuel consumption was then calculated for the average temperature for each vehicle. The table gives the constants in the least square analysis. The 80% confidence limits on the averages are about ±1.1% for the Pinto and less than ±1% for the Plymouth. This difference between cars is most probably due to the difference in precision of the fuel meters.

In another set of tests using the trimerate ester of Example 1, a 1973 Ford Galaxie having a 351 CID V-8 engine was idled at 700–730 rpm. with the sump temperature at equilibrium, i.e. about 210° F. The automobile was equipped with a Conaflow fuel meter that reads to the nearest 0.0001 gal. The test comprised measuring the time, in seconds, to consume 0.1 gal. of fuel in 0.01 segments (for a total of 10 data points). The engine was allowed to run 10 minutes, then the test was repeated. The two sequences constituted a single test. A least square analysis of the data points showed the fuel consumption rate, as follows:

| Lubricant | % Increase in Idle | % Improvement in Fuel Economy at Constant Idle* |
|---|---|---|
| 2% of Ester in Mobil Super | 6.9 | 6.4 |
| 2% of Ester in Mobil 1 | 4.9 | 5.0 |

*Compared to same oil with no ester.

In six additional vehicles tested under standard EPA conditions on chasis dynamometer, 2% of ester in an SAE 10W-30 oil gave an improvement (over the unaided lubricating oil) ranging from 0.8% to 3.0%, with an average of 1.9% for the six cars.

The ester was also tested in Tecumseh single cylinder air cooled engines running at about 2400 rpm. The ester was placed in an SAE 10W HD oil or in Mobil 1. Using various fuels, e.g. Mobil regular and unleaded fuel and various engines, the % improvement (again as compared to the same oil having therein no ester) was substantial, ranging from 0.5 in one engine (using 10W HD oil and unleaded fuel) to a high of 7.5 in another engine (using the same oil, but with regular fuel).

I claim:

1. A method for reducing fuel consumption in an internal combustion engine by treating the moving surfaces thereof with a composition comprising a major amount of a lubricant containing a fuel reducing amount of an acid ester that is soluble in a predominant amount of a hydrocarbon oil, either mineral or synthetic, and that has at least two olefinic double bonds, at least one pair of which has one of the following configurations:

$$-C{=}C-C-C{=}C-$$

and $$-C{=}C-C{=}C-$$

or (2) the dimer or trimer of such acid ester whereby said acid ester, trimer or dimer is deposited on the said moving surfaces.

2. The method of claim 1 wherein the lubricant is a mineral oil.

3. The method of claim 1 wherein the lubricant is a synthetic hydrocarbon oil.

4. The method of claim 1 wherein the lubricant is a mixture of a mineral oil and a synthetic hydrocarbon oil.

5. The method of claim 3 wherein said synthetic hydrocarbon oil is in admixture with not more than about 20% by weight of another synthetic lubricating oil.

6. The method of claim 1 wherein the lubricant composition comprises a dimer, a trimer, or mixtures thereof, of a linoleic acid ester of the formula $$CH_3(CH_2)_4CH{=}CHCH_2CH{=}CH(CH_2)_7COOR'$$

wherein R′ is a $C_1$–$C_{20}$ hydrocarbyl group.

7. The method of claim 6 wherein R′ is aryl, aralkyl or alkyl.

8. The method of claim 6 wherein the lubricant is a mineral oil.

9. The method of claim 6 wherein the lubricant is a synthetic hydrocarbon oil.

10. The method of claim 6 wherein the lubricant is a mixture of mineral oil and a synthetic hydrocarbon oil.

11. The method of claim 9 wherein said synthetic hydrocarbon oil is in admixture with not more than about 20% by weight of another synthetic lubricating oil.

12. The method of claim 1 wherein the lubricant contains a fuel reducing amount of the triisodecyl ester of the trimer of linoleic acid.

13. The method of claim 12 wherein the lubricant is a mineral oil.

14. The method of claim 12 wherein the lubricant is a mixture of synthetic hydrocarbon oil and not more than 20% by weight of another synthetic lubricating oil.

15. The method of claim 12 comprising from about 0.5% to about 10% by weight of said ester.

* * * * *